United States Patent [19]

Ripple et al.

[11] Patent Number: 4,957,649

[45] Date of Patent: Sep. 18, 1990

[54] LUBRICATING OIL COMPOSITIONS AND CONCENTRATES

[75] Inventors: David E. Ripple; William B. Chamberlin, III, both of Kirtland, Ohio

[73] Assignee: The Lubrizol Corporation, Wickliffe, Ohio

[21] Appl. No.: 226,765

[22] Filed: Aug. 1, 1988

[51] Int. Cl.[5] ..... C01M 141/02

[52] U.S. Cl. ..... 252/32.7 E; 252/51.5 A; 252/56 R; 252/33.3; 252/39

[58] Field of Search ..... 252/32.7 E, 51.5 A, 252/33.3, 39, 56 R

[56] References Cited

U.S. PATENT DOCUMENTS

| | | | |
|---|---|---|---|
| Re. 26,330 | 1/1968 | Colfer | 208/48 |
| Re. 27,331 | 4/1972 | Coleman | 252/47.5 |
| 2,875,221 | 2/1959 | Birnbaum | 260/410.7 |
| 2,911,367 | 11/1959 | Baus et al. | 252/32.7 |
| 3,172,892 | 3/1965 | Le Suer et al. | 260/326.5 |
| 3,215,707 | 11/1965 | Rense | 260/326.3 |
| 3,219,666 | 11/1965 | Norman et al. | 260/268 |
| 3,231,587 | 1/1966 | Rense | 260/346.8 |
| 3,235,484 | 2/1966 | Colfer | 208/48 |
| 3,235,498 | 2/1966 | Waldmann | 252/49.6 |
| 3,272,746 | 9/1966 | Le Suer et al. | 252/47.5 |
| 3,372,116 | 3/1968 | Meinhardt | 252/36 |
| 3,381,022 | 4/1968 | Le Suer | 260/404.8 |
| 3,385,791 | 5/1968 | Colyer et al. | 252/32.7 |
| 3,410,798 | 11/1968 | Cohen | 252/37.2 |
| 3,522,179 | 7/1970 | Le Seur | 252/51.5 |
| 3,562,159 | 2/1971 | Mastin | 252/32.7 |
| 3,576,743 | 4/1971 | Wildmer et al. | 252/51.5 |
| 3,632,510 | 1/1972 | Le Suer | 252/35 |
| 3,804,763 | 4/1974 | Meinhardt | 252/51.5 |
| 3,912,764 | 10/1975 | Palmer, Jr. | 260/346.8 |
| 3,920,562 | 11/1975 | Foehr | 252/32.7 E |
| 3,933,659 | 1/1976 | Lyle et al. | 252/32.7 |
| 3,948,800 | 4/1976 | Meinhardt | 252/356 |
| 3,957,854 | 5/1976 | Miller | 260/482 |
| 4,010,106 | 3/1977 | Rathert | 252/32.7 E |
| 4,105,571 | 8/1978 | Shaub et al. | 252/32.7 E |
| 4,110,349 | 8/1978 | Cohen | 260/346.74 |
| 4,113,639 | 9/1978 | Lonstrup et al. | 252/51.5 |
| 4,119,549 | 10/1978 | Davis | 252/45 |
| 4,234,435 | 11/1980 | Meinhardt et al. | 252/32.7 E |
| 4,263,150 | 4/1981 | Clason et al. | 252/32.7 |
| 4,289,635 | 9/1981 | Schroeck | 252/32.7 |
| 4,304,678 | 12/1981 | Schick et al. | 252/56 R |
| 4,308,154 | 12/1981 | Clason et al. | 252/32.7 |
| 4,455,243 | 6/1984 | Liston | 252/49.6 |
| 4,466,895 | 8/1984 | Schroeck | 252/32.7 E |
| 4,505,830 | 3/1985 | Vinci | 252/33 |
| 4,683,069 | 7/1987 | Brewster et al. | 252/32.7 E |

FOREIGN PATENT DOCUMENTS

| | | |
|---|---|---|
| 0092946 | 11/1983 | European Pat. Off. . |
| 0294096 | 12/1988 | European Pat. Off. . |
| 0311319 | 4/1989 | European Pat. Off. . |
| 0317348 | 5/1989 | European Pat. Off. . |
| 0317354 | 5/1989 | European Pat. Off. . |
| 1233858 | 10/1960 | France . |
| WO8704454 | 7/1987 | PCT Int'l Appl. . |
| 1440219 | 9/1973 | United Kingdom . |
| 1485155 | 9/1977 | United Kingdom . |
| 2062672 | 5/1981 | United Kingdom . |
| 2102023 | 1/1983 | United Kingdom . |

OTHER PUBLICATIONS

Exxon Chemical Patents Inc., Oil-Soluble, Dispersant Additives for Fuels and Lubricating Oils 5/15/87.

WO87/01722, Ripple, David (et al.), Diesel Lubricants and Methods, 3/26/87.

*Primary Examiner*—Jacqueline V. Howard

*Attorney, Agent, or Firm*—Joseph P. Fischer; Frederick D. Hunter; Robert A. Franks

[57] ABSTRACT

Lubricating oil compositions for internal combustion engines are described with comprise (A) a major amount of oil of lubricating viscosity, and minor amounts of (B) at least one carboxylic derivative composition produced by reacting (B-1) at least one substituted succinic acylating agent with (B-2) at least one amine compound characterized by the present within its structure of at least one HN< group (C) at least one partial fatty acid ester of a polyhydric alcohol, and (D) at least one metal salt of a dihydrocarbyl dithiosphosphoric acid. The oil compositions also may contain (E) at least one carboxylic ester derivative composition, and/or (F) at least one neutral or basic alkaline earth metal salt of at least one acidic organic compound.

42 Claims, No Drawings

LUBRICATING OIL COMPOSITIONS AND CONCENTRATES

FIELD OF THE INVENTION

This invention relates to lubricating oil compositions. In particular, this invention relates to lubricating oil compositions comprising an oil of lubricating viscosity, a carboxylic derivative composition exhibiting both VI and dispersant properties, at least one partial fatty acid ester of a polyhydric alcohol, and at least one metal salt of a dithiophosphoric acid.

BACKGROUND OF THE INVENTION

Lubricating oils which are utilized in internal combustion engines, and in particular, in spark-ignited and diesel engines are constantly being modified and improved to provide improved performance. Various organizations including the SAE (Society of Automotive Engineers), the ASTM (formerly the American Society for Testing and Materials) and the API (American Petroleum Institute) as well as the automotive manufacturers continually seek to improve the performance of lubricating oils. Various standards have been established and modified over the years through the efforts of these organizations. As engines have increased in power output and complexity, the performance requirements have been increased to provide lubricating oils that will exhibit a reduced tendency to deteriorate under conditions of use and thereby to reduce wear and the formation of such undesirable deposits as varnish, sludge, carbonaceous materials and resinous materials which tend to adhere to the various engine parts and reduce the efficiency of the engines.

In general, different classifications of oils and performance requirements have been established for crankcase lubricants to be used in spark-ignited engines and diesel engines because of the differences in/and the demands placed on, lubricating oils in these applications. Commercially available quality oils designed for spark-ignition engines have been identified and labeled in recent years as "SF" oils, when the oils are capable of satisfying the performance requirements of API Service Classification SF. A new API Service Classification SG has recently been established, and this oil is to be labeled "SG". The oils designated as SG must pass the performance requirements of API Service Classification SG which have been established to insure that these new oils will possess additional desirable properties and performance capabilities in excess of those required for SF oils. The SG oils are to be designed to minimize engine wear and deposits and also to minimize thickening in service. The SG oils are intended to improve engine performance and durability when compared to all previous engine oils marketed for spark-ignition engines. An added feature of SG oils is the inclusion of the requirements of the CC category (diesel) into the SG specification.

In order to meet the performance requirements of SG oils, the oils must successfully pass the following gasoline and diesel engine tests which have been established as standards in the industry: The Ford Sequence VE Test; The Buick Sequence IIIE Test; The Oldsmobile Sequence IID Test; The CRC L-38 Test; and The Caterpillar Single Cylinder Test Engine 1H2. The Caterpillar Test is included in the performance requirements in order to also qualify the oil for the light duty diesel use (diesel performance catetory "CC"). If it is desired to have the SG classification oil also qualify for heavy-duty diesel use, (diesel category "CD") the oil formulation must pass the more stringent performance requirements of the Caterpillar Single Cylinder Test Engine 1G2. The requirements for all of these tests have been established by the industry, and the tests are described in more detail below.

When it is desired that the lubricating oils of the SG classification also exhibit improved fuel economy, the oil must meet the requirements of the Sequence VI Fuel Efficient Engine Oil Dynamometer Test.

A new classification of diesel engine oil also has been established through the joint efforts of the SAE, ASTM and the API, and the new diesel oils will be labeled "CE". The oils meeting the new diesel classification CE will have to be capable of meeting additional performance requirements not found in the present CD category including the Mack T-6, Mack T-7, and the Cummins NTC-400 Tests.

An ideal lubricant for most purposes should possess the same viscosity at all temperatures. Available lubricants, however, depart from this ideal. Materials which have been added to lubricants to minimize the viscosity change with temperature are called viscosity-modifiers, viscosity-improvers, viscosity-index-improvers or VI improvers. In general, the materials which improve the VI characteristics of lubricating oils are oil-soluble organic polymers, and these polymers include polyisobutylenes, polymethacrylates (i.e., copolymers of various chain length alkyl methacrylates); copolymers of ethylene and propylene; hydrogenated block copolymers of styrene and isoprene; and polyacrylates (i.e., copolymers of various chain length alkyl acrylates).

Other materials have been included in the lubricating oil compositions to enable the oil compositions to meet the various performance requirements, and these include, dispersants, detergents, friction-modifiers, corrosion-inhibitors, etc. Dispersants are employed in lubricants to maintain impurities, particularly those formed during operation of an internal combustion engine, in suspension rather than allowing them to deposit as sludge. Materials have been described in the prior art which exhibit both viscosity-improving and dispersant properties. One type of compound having both properties is comprised of a polymer backbone onto which backbone has been attached one or more monomers having polar groups. Such compounds are frequently prepared by a grafting operation wherein the backbone polymer is reacted directly with a suitable monomer.

Dispersant additives for lubricants comprising the reaction products of hydroxy compounds or amines with substituted succinic acids or their derivatives also have been described in the prior art, and typical dispersants of this type are disclosed in, for example, U.S. Pat. Nos. 3,272,746; 3,522,179; 3,219,666; and 4,234,435. When incorporated into lubricating oils, the compositions described in the '435 patent function primarily as dispersants/detergents and viscosity-index improvers.

SUMMARY OF THE INVENTION

A lubricating oil formulation is described which is useful in internal combustion engines. More particularly, lubricating oil compositions for internal combustion engines are described with comprise (A) a major amount of oil of lubricating viscosity, and minor amounts of (B) at least one carboxylic derivative composition produced by reacting (B-1) at least one substituted succinic acylating agent with (B-2) from one equivalent up to about 2 moles, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{Mn}$ value of about 1300 to about 5000 and an $\overline{Mw}/\overline{Mn}$ value of about 1.5 to about 4.5, said acylating agents being characterized by the presence within their structure of an average of at least 1.3 succinic groups for each equivalent weight of substituent groups, (C) at least one partial fatty acid ester of a polyhydric alcohol, and (D) at least one metal salt of a dihydrocarbyl dithiophosphoric acid wherein (D-1) the dithiophosphoric acid is prepared by reacting phosphorus pentasulfide with an alcohol mixture comprising at least 10 mole percent of isopropyl alcohol, secondary butyl alcohol, or mixture of isopropyl and secondary butyl alcohols, and at least one primary aliphatic alcohol containing from about 3 to about 13 carbon atoms, and (D-2) the metal is a Group II metal, aluminum, tin, iron, cobalt, lead, molybdenum, manganese, nickel or copper. The oil compositions also may contain (E) at least one carboxylic ester derivative composition, and/or (F) at least one neutral or basic alkaline earth metal salt of at least one acidic organic compound. In one embodiment, the oil compositions of the present invention contain the above additives and other additives described in the specification in amounts sufficient to enable the oil to meet all the performance requirements of the API Service Classification identified as "SG", and in another embodiment the oil compositions of the invention will contain the above additives and other additives described in the specification in amounts sufficient to enable the oils to satisfy the requirement of the API Service Classification identified as "CE".

DESCRIPTION OF THE PREFERRED EMBODIMENTS

Throughout this specification and claims, references to percentages by weight of the various components, except for component (A) which is oil, are on a chemical basis unless otherwise indicated. For example, when the oil compositions of the invention are described as containing at least 2% by weight of (B), the oil composition comprises at least 2% by weight of (B) on a chemical basis. Thus, if component (B) is available as a 50% by weight oil solution, at least 4% by weight of the oil solution would be included in the oil composition.

The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the % N contained in the polyamine and multiplying by 100; thus, a polyamine mixture containing 34% N would have an equivalent weight of 41.2. An equivalent weight of ammonia or a monoamine is the molecular weight.

An equivalent weight of a hydroxyl-substituted amine to be reacted with the acylating agents to form the carboxylic derivative (B) is its molecular weight divided by the total number of nitrogen groups present in the molecule. For the purpose of this invention in preparing component (B), the hydroxyl groups are ignored when calculating equivalent weight. Thus, ethanolamine would have an equivalent weight equal to its molecular weight, and diethanolamine has an equivalent weight (based on nitrogen) equal to its molecular weight.

The equivalent weight of a hydroxyl-substituted amine used to form the carboxylic ester derivatives (E) useful in this invention is its molecular weight divided by the number of hydroxyl groups present, and the nitrogen atoms present are ignored. Thus, when preparing esters from, e.g., diethanolamine, the equivalent weight is one-half the molecular weight of diethanolamine.

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

(A) Oil of Lubricating Viscosity

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and sol- vent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl(4-methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled or reprocessed oils and often are additionally processed by techniques directed to removal of spent additives and oil breakdown products.

(B) Carboxylic Derivatives

Component (B) which is utilized in the lubricating oils of the present invention is at least one carboxylic derivative composition produced by reacting (B-1) at least one substituted succinic acylating agent with (B-2) from one equivalent up to two moles, per equivalent of acylating agent, of at least one amine compound containing at least one HN< group, and wherein said acylating agent consists of substituent groups and succinic groups wherein the substituent groups are derived from a polyalkene characterized by an $\overline{M}n$ value of about 1300 to about 5000 and an $\overline{M}w/\overline{M}n$ ratio of about 1.5 to about 4.5, said acylating agents being characterized by the presence within their structure of an average of at least about 1.3 succinic groups for each equivalent weight of substituent groups.

The carboxylic derivatives (B) are included in the oil compositions to improve dispersancy and VI properties of the oil compositions. In general from about 0.1% to about 10 or 15% by weight of component (B) can be included in the oil compositions, although the oil compositions preferably will contain at least 0.5% and more often at least 2% by weight of component (B).

The substituted succinic acylating agent (B-1) utilized the preparation of the carboxylic derivative (B) can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an $\overline{M}n$ (number average molecular weight) value of from about 1300 to about 5000, and an $\overline{M}w/\overline{M}n$ value of at least about 1.5 and more generally from about 1.5 to about 4.5 or about 1.5 to about 4.0. The abbreviation $\overline{M}w$ is the conventional symbol representing the weight average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

The second group or moiety in the acylating agent is referred to herein as the "succinic group(s)". The succinic groups are those groups characterized by the structure

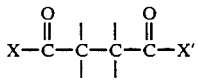

(I)

wherein X and X' are the same or different provided at least one of X and X' is such that the substituted succinic acylating agent can function as carboxylic acylating agents. That is, at least one of X and X' must be such that the substituted acylating agent can form amides or amine salts with amino compounds, and otherwise function as a conventional carboxylic acid acylating agents. Transesterification and transamidation reactions are considered, for purposes of this invention, as conventional acylating reactions.

Thus, X and/or X' is usually —OH, —O—-hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

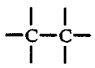

of Formula I forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of an average of at least 1.3 succinic groups (that is, groups corresponding to Formula I) for each equivalent weight of substituent groups. For purposes of this invention, the equivalent weight of substituent groups is deemed to be the number obtained by dividing the $\overline{M}n$ value of the polyalkene from which the substituent is derived into the total weight of the substituent groups present in the substituted succinic acylating agents. Thus, if a substituted succinic acylating agent is characterized by a total weight of substituent group of 40,000 and the $\overline{M}n$ value for the polyalkene from which the substituent groups are derived is 2000, then that substituted succinic acylating agent is characterized by a total of 20 (40,000/2000=20) equivalent weights of substituent groups. Therefore, that particular succinic acylating agent must also be characterized by the presence within its structure of at least 26 succinic groups to meet one of the requirements of the succinic acylating agents used in this invention.

Another requirement for the substituted succinic acylating agents is that the substituent groups must have been derived from a polyalkene characterized by an $\overline{M}w/\overline{M}n$ value of at least about 1.5. The upper limit of $\overline{M}w/\overline{M}n$ will generally be about 4.5. Values of from 1.5 to about 4.5 are particularly useful.

Polyalkenes having the $\overline{M}n$ and $\overline{M}w$ values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

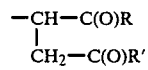

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

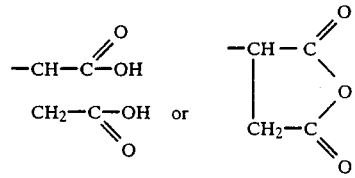

(III)

(A) (B)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.3. The maximum number generally will not exceed 4.5. Generally the minimum will be about 1.4 succinic groups for each equivalent weight of substituent group. A range based on this minimum is at least 1.4 to about 3.5, and more specifically about 1.4 to about 2.5 succinic groups per equivalent weight of substituent groups.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\overline{M}n$ for example, a minimum of about 1300 and a maximum of about 5000 are preferred with an $\overline{M}n$ value in the range of from about 1500 to about 5000 also being preferred. A more preferred $\overline{M}n$ value is one in the range of from about 1500 to about 2800. A most preferred range of $\overline{M}n$ values is from about 1500 to about 2400.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of $\overline{M}n$ or $\overline{M}w/\overline{M}n$. They are intended to be dependent in the sense that, for example, when a preference for a minimum of 1.4 or 1.5 succinic groups is combined with more preferred values of $\overline{M}n$ and/or $\overline{M}w/\overline{M}n$, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

In one embodiment, when the $\overline{M}n$ of a polyalkene is at the lower end of the range, e.g., about 1300, the ratio of succinic groups to substituent groups derived from said polyalkene in the acylating agent is preferably higher than the ratio when the $\overline{M}n$ is, for example, 1500. Conversely when the $\overline{M}n$ of the polyalkene is higher, e.g., 2000, the ratio may be lower than when the $\overline{M}n$ of the polyalkene is, e.g., 1500.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolyers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., $>C{=}C<$); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group

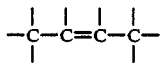

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

Some of the substituted succinic acylating agents (B-1) useful in preparing the carboxylic esters (B) are known in the art and are described in, for example, U.S. Pat. No. 4,234,435, the disclosure of which is hereby incorporated by reference. The acylating agents described in the '435 patent are characterized as containing substituent groups derived from polyalkenes having an $\overline{M}n$ value of about 1300 to about 5000, and an $\overline{M}w/\overline{M}n$ value of about 1.5 to about 4. In addition to the acylating agents described in the '435 patent, the acylating agents useful in this invention may contain substituent groups derived from polyalkenes having an $\overline{M}w/\overline{M}n$ ratio of up to about 4.5.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Obviously, preparing polyalkenes as described above which meet the various criteria for $\overline{M}n$ and $\overline{M}w./\overline{M}n$ is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes is reacted with one or more acidic reactants selected from the group consisting of maleic or fumaric reactants of the general formula $$X(O)C{-}CH{=}CH{-}C(O)X' \qquad \text{(IV)}$$

wherein X and X' are as defined hereinbefore in Formula I. Preferably the maleic and fumaric reactants will be one or more compounds corresponding to the formula $$RC(O){-}CH{=}CH{-}C(O)R' \qquad \text{(V)}$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

For convenience and brevity, the term "maleic reactant" is often used hereinafter. When used, it should be understood that the term is generic to acidic reactants selected from maleic and fumaric reactants corresponding to Formulae (IV) and (V) above including a mixture of such reactants.

The acylating reagents described above are intermediates in processes for preparing the carboxylic derivative compositions (B) comprising reacting (B-1) one or more acylating reagents with (B-2) at least one amino compound characterized by the presence within its structure of at least one HN< group.

The amino compound (B-2) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., $-NH_2$) and more preferably the amine is a polyamine, especially a polyamine containing at least two —NH— groups, either or both of which are primary or secondary amines. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced V.I. improving properties.

Among the preferred amines are the alkylene polyamines, including the polyalkylene polyamines. The alkylene polyamines include those conforming to the formula $$\begin{array}{l} R^3N-(U-N)_n-R^3 \\ \quad\;\; | \qquad\;\; | \\ \quad\;\; R^3 \qquad R^3 \end{array} \qquad \text{(VI)}$$

wherein n is from 1 to about 10; each $R^3$ is independently a hydrogen atom, a hydrocarbyl group or a hydroxysubstituted or amine-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms. Preferably U is ethylene or propylene. Especially preferred are the alkylene polyamines where each $R^3$ is hydrogen or an amino-substituted hydrocarbyl group with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkl-substituted piperazines are also included.

Alkylene polyamines useful in preparing the carboxylic derivative compositions (B) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2,aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing carboxylic derivative (B) useful in this invention. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines which can be reacted with the acylating agents (B-1) in accordance with these inventions are described in, for example, U.S. Pat. Nos. 3,219,666 and 4,234,435, and these patents are hereby incorporated by reference for their disclosures of amines which can be reacted with the acylating agents described above to form the carboxylic derivatives (B) of this invention.

The carboxylic derivative compositions (B) produced from the acylating reagents (B-1) and the amino compounds (B-2) described hereinbefore comprise acylated amines which include amine salts, amides, imides and imidazolines as well as mixtures thereof. To prepare the carboxylic acid derivatives from the acylating reagents and the amino compounds, one or more acylating reagents and one or more amino compounds are heated, optionally in the presence of a normally liquid, substantially inert organic liquid solvent/diluent, at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from one equivalent up to about 2 moles of amino compound per equivalent of acylating reagent.

Because the acylating reagents (B-1) can be reacted with the amine compounds (B-2) in the same manner as the high molecular weight acylating agents of the prior art are reacted with amines, U.S. Pat. Nos. 3,172,892; 3,219,666; 3,272,746; and 4,234,435 are expressly incorporated herein by reference for their disclosures with respect to the procedures applicable to reacting the acylating reagents with the amino compounds as described above.

In order to produce carboxylic derivative compositions exhibiting viscosity index improving capabilities, it has been found generally necessary to react the acylating reagents with polyfunctional amine reactants. For example, polyamines having two or more primary and/or secondary amino groups are preferred. Obviously, however, it is not necessary that all of the amino compound reacted with the acylating reagents be polyfunctional. Thus, combinations of mono- and polyfunctional amino compounds be used.

The relative amounts of the acylating agent (B-1) and amino compound (B-2) used to form the carboxylic derivative compositions (B) used in the lubricating oil compositions of the present invention is a critical feature of the carboxylic derivative compositions used in this invention. It is essential that the acylating agent be reacted with at least one equivalent of the amino compound per equivalent of acylating agent.

In one embodiment, the acylating agent is reacted with from about 1.0 to about 1.1 or up to about 1.5 equivalents of amino compound, per equivalent of acylating agent. In other embodiments, increasing amounts of the amino compound are used.

The amount of amine compound (B-2) within these ranges that is reacted with the acylating agent (B-1) may also depend in part on the number and type of nitrogen atoms present. For example, a smaller amount of a polyamine containing one or more —$NH_2$ groups is required to react with a given acylating agent than a polyamine having the same number of nitrogen atoms and fewer or no —$NH_2$ groups. One —$NH_2$ group can react with two —COOH groups to form an imide. If only secondary nitrogens are present in the amine compound, each >NH group can react with only one —COOH group. Accordingly, the amount of polyamine within the above ranges to be reacted with the acylating agent to form the carboxylic derivatives of the invention can be readily determined from a consideration of the number and types of nitrogen atoms in the polyamine (i.e., —$NH_2$, >NH, and >N—).

In addition to the relative amounts of acylating agent and amino compound used to form the carboxylic derivative composition (B), other critical features of the carboxylic derivative compositions used in this invention are the $\overline{M}n$ and the $\overline{M}w/\overline{M}n$ values of the polyalkene as well as the presence within the acylating agents of an average of at least 1.3 succinic groups for each equivalent weight of substituent groups. When all of these features are present in the carboxylic derivative compositions (B), the lubricating oil compositions of the present invention exhibit novel and improved properties, and the lubricating oil compositions are characterized by improved performance in combustion engines.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\text{Mn})(\text{Sap No., corrected})}{112{,}200\text{-}98(\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The preparation of the acylating agents is illustrated in the following Examples 1–3 and the preparation of the carboxylic acid derivative compositions (B) is illustrated by the following Examples B-1 to B-9. These examples illustrate presently preferred embodiments. In the following examples, and elsewhere in the specification and claims, all percentages and parts are by weight unless otherwise clearly indicated.

Acylating Agents:

EXAMPLE 1

A mixture of 510 parts (0.28 mole) of polyisobutene ($\overline{M}n$=1845; $\overline{M}w$=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired polyisobutene-substituted succinic acylating agent having a saponification equivalent number of 87 as determined by ASTM procedure D-94.

EXAMPLE 2

A mixture of 1000 parts (0.495 mole) of polyisobutene ($\overline{M}n$=2020; $\overline{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface.

At 184°–189° C. an additional 59 parts (0.83 mole) of chlorine is added over 4 hours. The reaction mixture is stripped by heating at 186°–190° C. with nitrogen blowing for 26 hours. The residue is the desired polyisobutene-substituted succinic acylating agent having a saponification equivalent number of 87 as determined by ASTM procedure D-94.

EXAMPLE 3

A mixture parts of polyisobutene chloride, prepared by the addition of 251 parts of gaseous chlorine to 3000 parts of polyisobutene ($\overline{M}n=1696$; $\overline{M}w=6594$) at 80° C. in 4.66 hours, and 345 parts of maleic anhydride is heated to 200° C. in 0.5 hour. The reaction mixture is held at 200°–224° C. for 6.33 hours, stripped at 210° C. under vacuum and filtered. The filtrate is the desired polyisobutene-substituted succinic acylating agent having a saponification equivalent number of 94 as determined by ASTM procedure D-94.

Carboxylic Derivative Compositions (B):

EXAMPLE B-1

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 1 at 138° C. The reaction mixture is heated to 150° C. in 2 hours and stripped by blowing with nitrogen. The reaction mixture is filtered to yield the filtrate as an oil solution of the desired product.

EXAMPLE B-2

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example 2 at 140°–145° C. The reaction mixture is heated to 155° C. in 3 hours and stripped by blowing with nitrogen. The reaction mixture is filtered to yield the filtrate as an oil solution of the desired product.

Examples B-3 through B-9 are prepared by following the general procedure set forth in Example B-1.

EXAMPLE B-3

A mixture of 1132 parts of mineral oil and 709 parts (1.2 equivalents) of a substituted succinic acylating agent prepared as in Example 1 is prepared, and a solution of 56.8 parts of piperazine (1.32 equivalents) in 200 parts of water is added slowly from a dropping funnel to the above mixture at 130°–140° C. over approximately 4 hours. Heating is continued to 160° C. as water is removed. The mixture is maintained at 160°–165° C. for one hour and cooled overnight. After reheating the mixture to 160° C., the mixture is maintained at this temperature for 4 hours. Mineral oil (270 parts) is added, and the mixture is filtered at 150° C. through a filter aid. The filtrate is an oil solution of the desired product (65% oil) containing 0.65% nitrogen (theory, 0.86%).

EXAMPLE B-4

A mixture of 1968 parts of mineral oil and 1508 parts (2.5 equivalents) a substituted succinic acylating agent prepared as in Example 1 is heated to 145° C. whereupon 125.6 parts (3.0 equivalents) of a commercial mixture of ethylene polyamines as used in Example B-1 are added over a period of 2 hours while maintaining the reaction temperature at 145°–150° C. The reaction mixture is stirred for 5.5 hours at 150°–152° C. while blowing with nitrogen. The mixture is filtered at 150° C. with a filter aid. The filtrate is an oil solution of the desired product (55% oil) containing 1.20% nitrogen (theory, 1.17).

EXAMPLE B-5

A mixture of 4082 parts of mineral oil and 250.8 parts (6.24 equivalents) of a commercial mixture of ethylene polyamine of the type utilized in Example B-1 is heated to 110° C. whereupon 3136 parts (5.2 equivalents) of a substituted succinic acylating agent prepared as in Example 1 are added over a period of 2 hours. During the addition, the temperature is maintained at 110°–120° C. while blowing with nitrogen. When all of the amine has been added, the mixture is heated to 160° C. and maintained at this temperature for about 6.5 hours while removing water. The mixture is filtered at 140° C. with a filter aid, and the filtrate is an oil solution of the desired product (55% oil) containing 1.17% nitrogen (theory, 1.18).

EXAMPLE B-6

A mixture of 4158 parts of mineral oil and 3136 parts (5.2 equivalents) of a substituted succinic acylating agent prepared as in Example 1 is heated to 140° C. whereupon 312 parts (7.26 equivalents) of a commercial mixture of ethylene polyamines as used in Example B-1 are added over a period of one hour as the temperature increases to 140°–150° C. The mixture is maintained at 150° C. for 2 hours while blowing with nitrogen and at 160° C. for 3 hours. The mixture is filtered at 140° C. with a filter aid. The filtrate is an oil solution of the desired product (55% oil) containing 1.44% nitrogen (theory, 1.34).

EXAMPLE B-7

A mixture of 4053 parts of mineral oil and 287 parts (7.14 equivalents) of a commercial mixture of ethylene polyamines as used in Example B-1 is heated to 110° C. whereupon 3075 parts (5.1 equivalents) of a substituted succinic acylating agent prepared as in Example 1 are added over a period of one hour while maintaining the temperature at about 110° C. The mixture is heated to 160° C. over a period of 2 hours and held at this temperature for an additional 4 hours. The reaction mixture then is filtered at 150° C. with filter aid, and the filtrate is an oil solution of the desired product (55% oil) containing 1.33% nitrogen (theory, 1.36).

EXAMPLE B-8

A mixture of 1503 parts of mineral oil and 1220 parts (2 equivalents) of a substituted succinic acylating agent prepared as in Example 1 is heated to 110° C. whereupon 120 parts (3 equivalents) of a commercial mixture of ethylene polyamines of the type used in Example B-1 are added over a period of about 50 minutes. The reaction mixture is stirred an additional 30 minutes at 110° C., and the temperature is then raised to and maintained at about 151° C. for 4 hours. A filter aid is added and the mixture is filtered. The filtrate is an oil solution of the desired product (53.2% oil) containing 1.44% nitrogen (theory, 1.49).

EXAMPLE B-9

A mixture of 3111 parts of mineral oil and 844 parts (21 equivalents) of a commercial mixture of ethylene polyamine as used in Example B-1 is heated to 140° C. whereupon 3885 parts (7.0 equivalents) of a substituted succinic acylating agent prepared as in Example 1 are added over a period of about 1.75 hours as the temperature increases to about 150° C. While blowing with nitrogen, the mixture is maintained at 150°-155° C. for a period of about 6 hours and thereafter filtered with a filter aid at 130° C. The filtrate is an oil solution of the desired product (40% oil) containing 3.5% nitrogen (theory, 3.78).

(C) Partial Fatty Acid Ester of Polyhydric Alcohols:

Component (C) in the lubricating oil compositions of the present invention is at least one partial fatty acid ester of a polyhydric alcohol. Generally, from about 0.01 up to about 1% or 2% by weight of the partial fatty acid esters appears to provide the desired friction-modifying characteristics. The hydroxy fatty acid esters are selected from hydroxy fatty acid esters of dihydric or polyhydric alcohols or oil-soluble oxyalkylenated derivatives thereof.

The term "fatty acid" as used in the specification and claims refers to acids which may be obtained by the hydrolysis of a naturally occurring vegetable or animal fat or oil. These acids usually contain from about 8 to about 22 carbon atoms and include, for example, caprylic acid, caproic acid, palmitic acid, stearic acid, oleic acid, linoleic acid, etc. Acids containing from 10 to 22 carbon atoms generally are preferred, and in some embodiments, those acids containing from 16 to 18 carbon atoms are especially preferred.

The polyhydric alcohols which can be utilized in the preparation of the partial fatty acids contain from 2 to about 8 or 10 hydroxyl groups, more generally from about 2 to about 4 hydroxyl groups. Examples of suitable polyhydric alcohols include ethylene glycol, propylene glycol, neopentylene glycol, glycerol, pentaerythritol, etc. Ethylene glycol and glycerol are preferred. Polyhydric alcohols containing lower alkoxy groups such as methoxy and/or ethoxy groups may be utilized in the preparation of the partial fatty acid esters.

Suitable partial fatty acid esters of polyhydric alcohols (C) include, for example, glycol monoesters, glycerol mono- and diesters, and pentaerythritol di- and/or triesters. The partial fatty acid esters of glycerol are preferred, and of the glycerol esters, monoesters, or mixtures of monoesters and diesters are often utilized. The partial fatty acid esters of polyhydric alcohols can be prepared by methods well known in the art, such as by direct esterification of an acid with a polyol, reaction of a fatty acid with an epoxide, etc.

It is generally preferred that the partial fatty acid ester contain olefinic unsaturation, and this olefinic unsaturation usually is found in the acid moiety of the ester. In addition to natural fatty acids containing olefinic unsaturation such as oleic acid, octeneoic acids, tetradeceneoic acids, etc., can be utilized in forming the esters.

The partial fatty acid esters (C) utilized in the lubricating oil compositions of the present invention may be present as components of a mixture containing a variety of other components such as unreacted fatty acid, fully esterified polyhydric alcohols, and other materials. Commercially available partial fatty acid esters often are mixtures which contain one or more of these components such as mixtures of mono- and diesters (and some triester) of glycerol.

One method for preparing monoglycerides of fatty acids from fats and oils is described in Birnbaum U.S. Pat. No. 2,875,221. The process described in this patent is a continuous process for reacting glycerol and fats to provide a product having a high proportion of monoglyceride. Among the commercially available glycerol esters are ester mixtures containing at least about 30% by weight of monoester and generally from about 35% to about 65% by weight of monoester, about 30% to about 50% by weight of diester, and the balance in the aggregate, generally less than about 15%, is a mixture of triester, free fatty acid and other components. Specific examples of commercially available material comprising fatty acid esters of glycerol include Emery 2421 (Emery Industries, Inc.), Cap City GMO (Capital), DUR-EM 114, DUR-EM GMO, etc. (Durkee Industrial Foods, Inc.) and various materials identified under the mark MAZOL GMO (Mazer Chemicals, Inc.). Other examples of partial fatty acid esters of polyhydric alcohols may be found in K. S. Markley, Ed., "Fatty Acids", Second Edition, Parts I and V, Interscience Publishers (1968). Numerous commercially available fatty acid esters of polyhydric alcohols are listed by tradename and manufacturer in McCutcheons' Emulsifiers and Detergents, North American and International Combined Editions (1981).

The following examples illustrate the preparation of partial fatty acid esters of polyhydric alcohols.

EXAMPLE C-1

A mixture of glycerol oleates is prepared by reacting 882 parts of a high oleic-content sunflower oil which comprises about 80% oleic acid, about 10% linoleic acid and the balance saturated triglycerides, and 499 parts of glycerol in the presence of a catalyst prepared by dissolving potassium hydroxide in glycerol. The reaction is conducted by heating the mixture to 155° C. under a nitrogen sparge, and then heating under nitrogen for 3 hours at 155° C. The mixture is then cooled to less than 100° C., and 9.05 parts of 85% phosphoric acid are added to neutralize the catalyst. The neutralized reaction mixture is transferred to a 2-liter separatory funnel, and the lower layer is removed and discarded. The upper layer is the product which contains, by analysis, 56.9% by weight glycerol monooleate, 33.3% glycerol dioleate (primarily 1,2-) and 9.8% glycerol trioleate.

EXAMPLE C-2

A mixture of glycerol esters is prepared by reacting 2555 parts (2.89 moles) of sunflower oil as used in Example C-1 and 1443 parts (15.68 moles) of glycerol in the presence of 152 parts (0.46 mole) of a catalyst prepared by dissolving potassium hydroxide in glycerol. The reaction mixture is heated to 155° C. under a nitrogen atmosphere with stirring for about 13 hours, and the mixture is cooled to about 100° C. whereupon 26 parts of 85% phosphoric acid are added to neutralize the catalyst. The mixture is stirred an additional 20 minutes and allowed to settle at 90° C. for about 2 hours. The lower layer of unreated glycerol is removed, and the upper layer is the desired product which comprises, by analysis, 54.6% glycerol monooleate, 35.7% glycerol dioleate and 9.4% glycerol trioleate.

EXAMPLE C-3

A mixture of 69 parts (0.75 mole) of glycerol and 0.17 part (0.003 mole) of calcium oxide is prepared and stripped to 130° C./10 mm. Hg. The mixture is cooled to less than 50° C. whereupon 220.5 parts (0.25 mole) of sunflower oil are added. This mixture is heated at 150 mm. Hg. at 220° C. for one hour while removing some glycerol. The mixture is cooled to 150° C., and 0.18 part of 85% phosphoric acid is added immediately. A vacuum or 10 mm. Hg. is applied, and the reaction mixture is stripped to 200° C. to remove additional glycerol. The mixture is cooled to less than 50° C. under the vacuum, and a filter aid then is added with stirring. Filtration of the reaction mixture yields a filtrate which is the desired product which comprises, by analysis, 59.9% of the monoester, 35.5% of the diester and 4.0% of the triester.

EXAMPLE C-4

Sunflower oil (Trisun 80, 400 parts) is heated to 180° C. at 25 mm. Hg. To the sunflower oil is then added a mixture comprising 31 parts of glycerol and 0.31 parts of calcium oxide, and the new mixture is heated with stirring to 220° C. at 200 mm. Hg. and maintained at this temperature for one hour. To the reaction mixture is added 0.65 part of 85% phosphoric acid with stirring. The mixture then is stripped at 220° C./25 mm. Hg. for 15 minutes and then cooled to 70° C. The mixture is filtered through a filter aid, and the filtrate is the desired product which comprises, by analysis, 29.2% of unreacted sunflower oil, 50.5% of the diester and 18.9% of the monoester of glycerol.

EXAMPLE C-5

Calcium oxide (0.17 part) and 69 parts (0.75 mole) of glycerol are charged to a reaction vessel, and the mixture is heated to 120° C./15 mm. Hg. After maintaining the mixture at this temperature for about 10 minutes, the mixture is cooled under vacuum to 50° C., and the vacuum is released. Sunflower oil (220.5 parts, 0.25 mole) is added, and after applying a vacuum of 150 mm. Hg., the mixture is heated to 220° C. with stirring and maintained at this temperature for 2 hours. The mixture is cooled to 170° C., and the vacuum is released using nitrogen. To this reaction mixture is added 0.34 part of 85% phosphoric acid, and a vacuum of 130 mm. Hg. is applied. The mixture then is heated to 200° C. at 15 mm. Hg. to strip glycerol. When no additional glycerol can be removed, the mixture is cooled to 25° C. under vacuum, and the residue is filtered through a filter aid. The filtrate is the desired product comprising, by analysis, 62.7% of the monoester, 32.0% of the diester and 3.6% of the triester.

EXAMPLE C-6

A mixture of 333 parts (0.378 mole) of sunflower oil, 666 parts (1.017 moles) of coconut oil and 250 parts of glycerol is prepared and heated to 180° C. whereupon a preheated mixture of 60 parts of glycerol and 0.78 part of calcium oxide is added to the original mixture. The reaction mixture is heated to 220° C. at 180 mm. Hg. and maintained at this temperature for 1.75 hours. Phosphoric acid (1.6 parts, 85%) is added and the mixture is stirred for 10 minutes under vacuum. The mixture then is stripped to 230° C./0.1 mm. Hg. The residue comprises, by analysis, 46% monoester, 49% diester and 5% unreacted oil.

EXAMPLE C-7

A mixture of 804 parts (1.23 moles) of coconut oil and 300 parts of glycerol is prepared and heated to 175° C. under nitrogen. A preheated (175° C.) mixture of 69 parts of glycerol and 0.62 parts of calcium oxide is added to the reaction mixture, and the reaction vessel is heated to 220° C./200 mm. Hg. and maintained at this temperature for 1.75 hours. After cooling to 170° C., 1.4 parts of 85% phosphoric acid are added. After stirring for 10 minutes, the reaction mixture is stripped to 20° C./0.1 mm. Hg., cooled to 50° C., and the residue is filtered through a filter aid. The filtrate is the desired product comprising, by analysis, 38.9% of the monoester, 55.6% of the diester and 5.4% of the triester of glycerol.

EXAMPLE C-8

In this example, the fatty acid is high erucic rapeseed oil which is an oil extracted from a rapeseed or crabbe. The oil contains triglycerides which have fatty acid moieties and wherein 40% or more of such moieties are erucic acid moieties. A mixture of 5010 parts (5.18 moles) of the high erucic rapeseed oil and 750 parts (23.4 moles) of anhydrous methanol is prepared and 100 parts of sodium methylate (25%) are added. This mixture is heated to 65° C. under nitrogen while stirring for 3 hours. Glycerol (2530 parts, 27.5 moles) is added along with an additional 100 parts of the sodium methylate. The reaction mixture is heated to 155° C. under nitrogen while removing methanol over a period of 15 hours. When no additional methanol can be removed, the mixture is cooled to 100° C. and 54 parts of 85% of phosphoric acid are added with stirring. The mixture is cooled to room temperature without stirring, and two layers form. The lower layer (primarily glycerol) is removed, and the upper layer is the desired product comprising, by analysis, 56.9% of the monoester, 32.7% of the diester and 8.5% of the triester product.

(D) Metal Dihydrocarbyl Dithiophosphate:

The oil compositions of the present invention also contain (D) at least one metal salt of a dihydrocarbyl dithiophosphoric acid wherein (D-1) the dithiophosphoric acid is prepared by reacting phosphorus pentasulfide with an alcohol mixture comprising at least 10 mole percent of isopropyl alcohol, secondary butyl alcohol, or a mixture of isopropyl and secondary butyl alcohols, and at least one primary aliphatic alcohol containing from about 3 to about 13 carbon atoms, and (D-2) the metal is a Group II metal, aluminum, tin, iron, cobalt, lead, molybdenum, manganese, nickel or copper.

Generally, the oil compositions of the present invention will contain varying amounts of one or more of the above-identified metal dithiophosphates such as from about 0.01 to about 2% by weight, and more generally from about 0.01 to about 1% by weight based on the weight of the total oil composition. The metal dithiophosphates (D) improve the antiwear and antioxidation characteristics of the oil composition of the invention.

The phosphorodithioic acids from which the metal salts useful in this invention are prepared are obtained by the reaction of about 4 moles of an alcohol mixture per mole of phosphorus pentasulfide, and the reaction may be carried out within a temperature range of from about 50° to about 200° C. The reaction generally is completed in about 1 to 10 hours, and hydrogen sulfide is liberated during the reaction.

The alcohol mixtures which are utilized in the preparation of the dithiophosphoric acids useful in this invention comprise mixtures of isopropyl alcohol, secondary butyl alcohol or a mixture of isopropyl and secondary butyl alcohols, and at least one primary aliphatic alcohol containing from about 3 to 13 carbon atoms. In particular, the alcohol mixture will contain at least 10 mole percent of isopropyl and/or secondary butyl alcohol and will generally comprise from about 20 mole percent to about 90 mole percent of isopropyl alcohol. In one preferred embodiment, the alcohol mixture will comprise from about 40 to about 60 mole percent of isopropyl alcohol, the remainder being one or more primary aliphatic alcohols.

The primary alcohols which may be included in the alcohol mixture include n-butyl alcohol, isobutyl alcohol, n-amyl alcohol, isoamyl alcohol, n-hexyl alcohol, 2-ethyl-1-hexyl alcohol, isooctyl alcohol, nonyl alcohol, decyl alcohol, dodecyl alcohol, tridecyl alcohol, etc. The primary alcohols also may contain various substituent groups such as halogens. Particular examples of useful mixtures of alcohols include, for example, isopropyl/n-butyl; isopropyl/secondary butyl; isopropyl/2-ethyl-1-hexyl; isopropyl/isooctyl; isopropyl/decyl; isopropyl/dodecyl; and isopropyl/tridecyl. In one preferred embodiment, the primary alcohols will contain from about 6 to about 13 carbon atoms, and the total number of carbon atoms per phosphorus atom will be at least 9.

The composition of the phosphorodithioic acid obtained by the reaction of a mixture of alcohols (e.g., iPrOH and $R^2OH$) with phosphorus pentasulfide is actually a statistical mixture of three or more phosphorodithioic acids as illustrated by the following formulae:

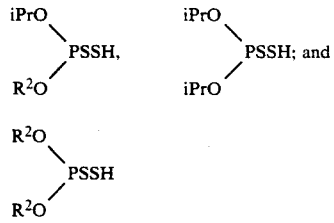

In the present invention it is preferred to select the amount of the two or more alcohols reacted with $P_2S_5$ to result in a mixture in which the predominating dithiophosphoric acid is the acid (or acids) containing one isopropyl group or one secondary isobutyl group, and one primary alkyl group. The relative amounts of the three phosphorodithioic acids in the statistical mixture is dependent, in part, on the relative amounts of the alcohols in the mixture, steric effects, etc.

The preparation of the metal salt of the dithiophosphoric acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide with one equivalent of phosphorodithioic acid.

The metal salts of dithiophosphates (D) which are useful in this invention include those salts containing Group II metals, aluminum, lead, tin, molybdenum, manganese, cobalt, and nickel. Zinc and copper are especially useful metals. Examples of useful metal salts of dihydrocarbyl dithiophosphoric acids, and methods for preparing such salts are found in the prior art such as U.S. Pat. Nos. 4,263,150; 4,289,635; 4,308,154; 4,322,479; 4,417,990; and 4,466,895, and the disclosures of these patents are hereby incorporated by reference.

The following examples illustrate the preparation of the metal salts of dithiophosphoric acid prepared from mixtures of alcohols containing isopropyl alcohol and at least one primary alcohol.

EXAMPLE D-1

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE D-2

(a) A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through a filter aid.

(b) Zinc oxide (282 parts, 6.87 moles) is charged to a reactor with 278 parts of mineral oil. The phosphorodithioic acid prepared in (a) (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm.Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

EXAMPLE D-3

(a) Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

(b) A reactor is charged with 312 parts (7.7 equivalents) of zinc oxide and 580 parts of mineral oil. While stirring at room temperature, the phosphorodithioic acid prepared in (a) (2287 parts, 6.97 equivalents) is added over a period of about 1.26 hours with an exotherm to 54° C. The mixture is heated to 78° C. and maintained at 78°-85° C. for 3 hours. The reaction mixture is vacuum stripped to 100° C. at 19 mm.Hg. The residue is filtered through a filter aid, and the filtrate is an oil solution (19.2% oil) of the desired zinc salt containing 7.86% zinc, 7.76% phosphorus and 14.8% sulfur.

EXAMPLE D-4

The general procedure of Example D-3 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE D-5

A phosphorodithioic acid is prepared in accordance with the general procedure of Example D-3 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles) of zinc oxide with 950.8 parts (3.20 moles) of the above-prepared phosphorodithioic acid. The product prepared in this manner is an oil solution (10% mineral oil) of the desired zinc salt, and the oil solution contains 9.36% zinc, 8.81% phosphorus and 18.65% sulfur.

EXAMPLE D-6

(a) A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while stirring. The reaction then is maintained at 60°-65° C. for about one hour and filtered. The filtrate is the desired phosphorodithioic acid.

(b) An oil slurry of 188.6 parts (4 moles) of zinc oxide and 144.2 parts of mineral oil is prepared, and 1145 parts of the phosphorodithioic acid prepared in (a) are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

EXAMPLE D-7

A phosphorodithioic acid is prepared by the general procedure of Example D-3 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 mm.Hg., the mixture is filtered twice through a filter aid, and the filtrate is an oil solution (10% mineral oil) of the zinc salt containing 10.06% zinc, 9.04% phosphorus, and 19.2% sulfur.

EXAMPLE D-8

(a) A mixture of 259 parts (3.5 moles) of normal butyl alcohol and 90 parts (1.5 moles) of isopropyl alcohol is heated to 40° C. under a nitrogen atmosphere whereupon 244.2 parts (1.1 moles) of phosphorus pentasulfide are added in portions over a period of one hour while maintaining the temperature of the mixture of between about 55°-75° C. The mixture is maintained at this temperature for an additional 1.5 hours upon completion of the addition of the phosphorus pentasulfide and then cooled to room temperature. The reaction mixture is filtered through a filter aid, and the filtrate is the desired phosphorodithioic acid.

(b) Zinc oxide (67.7 parts, 1.65 equivalents) and 51 parts of mineral oil are charged to a 1-liter flask and 410.1 parts (1.5 equivalents) of the phosphorodithioic acid prepared in (a) are added over a period of one hour while raising the temperature gradually to about 67° C. Upon completion of the addition of the acid, the reaction mixture is heated to 74° C. and maintained at this temperature for about 2.75 hours. The mixture is cooled to 50° C., and a vacuum is applied while raising the temperature to about 82° C. The residue is filtered, and the filtrate is the desired product. The product is a clear, yellow liquid containing 21.0% sulfur (19.81 theory), 10.71% zinc (10.05 theory), and 10.17% phosphorus (9.59 theory).

EXAMPLE D-9

(a) A mixture of 240 (4 moles) parts of isopropyl alcohol and 444 parts of n-butyl alcohol (6 moles) is prepared under a nitrogen atmosphere and heated to 50° C. whereupon 504 parts of phosphorus pentasulfide (2.27 moles) are added over a period of 1.5 hours. The reaction is exothermic to about 68° C., and the mixture is maintained at this temperature for an additional hour after all of the phosphorus pentasulfide is added. The mixture is filtered through a filter aid, and the filtrate is the desired phosphorodithioic acid.

(b) A mixture of 162 parts (4 equivalents) of zinc oxide and 113 parts of a mineral oil is prepared, and 917 parts (3.3 equivalents) of the phosphorodithioic acid prepared in (a) are added over a period of 1.25 hours. The reaction is exothermic to 70° C. After completion of the addition of the acid, the mixture is heated for three hours at 80° C., and stripped to 100° C. at 35 mm.Hg. The mixture then is filtered twice through a filter aid, and the filtrate is the desired product. The product is a clear, yellow liquid containing 10.71% zinc (9.77 theory), 10.4% phosphorus and 21.35% sulfur.

EXAMPLE D-10

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°-77° C. The mixture is stirred an additional hour while cooling. The material is filtered through a filter aid, and the filtrate is the desired phosphorodithioic acid.

(b) A mixture of 113 parts (2.76 equivalents) of zinc oxide and 82 parts of mineral oil is prepared and 662 parts of the phosphorodithioic acid prepared in (a) are added over a period of 20 minutes. The reaction is exothermic and the temperature of the mixture reaches 70° C. The mixture then is heated to 90° C. and maintained at this temperature for 3 hours. The reaction mixture is stripped to 105° C. and 20 mm.Hg. The residue is filtered through a filter aid, and the filtrate is the desired product containing 10.17% phosphorus, 21.0% sulfur and 10.98% zinc.

EXAMPLE D-11

A mixture of 69 parts (0.97 equivalent) of cuprous oxide and 38 parts of mineral oil is prepared and 239 parts (0.88 equivalent) of the phosphorodithioic acid prepared in Example D-10(a) are added over a period of about 2 hours. The reaction is slightly exothermic during the addition, the mixture is thereafter stirred for an additional 3 hours while maintaining the temperature at about 70° C. The mixture is stripped to 105° C./10 mm.Hg. and filtered. The filtrate is a dark-green liquid containing 17.3% copper.

EXAMPLE D-12

A mixture of 29.3 parts (1.1 equivalents) of ferric oxide and 33 parts of mineral oil is prepared, and 273 parts (1.0 equivalent) of the phosphorodithioic acid prepared in Example D-10(a) are added over a period of 2 hours. The reaction is exothermic during the addition, and the mixture is thereafter stirred an additional 3.5 hours while maintaining the mixture at 70° C. The product is stripped to 105° C./10 mm.Hg. and filtered through a filter aid. The filtrate is a black-green liquid containing 4.9% iron and 10.0% phosphorus.

EXAMPLE D-13

A mixture of 239 parts (0.41 mole) of the product of Example D-10(a), 11 parts (0.15 mole) of calcium hydroxide and 10 parts of water is heated to about 80° C. and maintained at this temperature for 6 hours. The product is stripped to 105° C./10 mm.Hg. and filtered through a filter aid. The filtrate is a molasses-colored liquid containing 2.19% calcium.

EXAMPLE D-14

The procedure of Example D-1 is repeated except that the ZnO is replaced by an equivalent amount of cuprous oxide.

In addition to the metal salts of dithiophosphoric acids derived from mixtures of alcohols comprising isopropyl alcohol (and/or secondary butyl alcohol), and one or more primary alcohols as described above, the lubricating oil compositions of the present invention also may contain metal salts of other dithiophosphoric acids. These additional phosphorodithioic acids are prepared from (a) a single alcohol which may be either a primary or secondary alcohol or (b) mixtures of primary alcohols or (c) mixtures of isopropyl alcohol and secondary alcohols or (d) mixtures of primary alcohols and secondary alcohols other than isopropyl alcohol, or (e) mixtures of secondary alcohols.

The additional metal phosphorodithioates which can be utilized in combination with component (D) in the lubricating oil compositions of the present invention generally may be represented by the formula

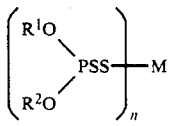

(VII)

wherein $R^1$ and $R^2$ are hydrocarbyl groups containing from 3 to about 10 carbon atoms, M is a Group I metal, a Group II metal, aluminum, tin, iron, cobalt, lead, molybdenum, manganese, nickel or copper, and n is an integer equal to the valence of M. The hydrocarbyl groups $R^1$ and $R^2$ in the dithiophosphate of Formula VII may be alkyl, cycloalkyl, arylalkyl or alkaryl groups, or a substantially hydrocarbon group of similar structure. By "substantially hydrocarbon" is meant hydrocarbons which contain substituent groups such as ether, ester, nitro or halogen which do not materially affect the hydrocarbon character of the group.

In one embodiment, one of the hydrocarbyl groups ($R^1$ or $R^2$) is attached to the oxygen through a secondary carbon atom, and in another embodiment, both hydrocarbyl groups ($R^1$ and $R^2$) are attached to the oxygen atom through secondary carbon atoms.

Illustrative alkyl groups include isopropyl, isobutyl, n-butyl, sec-butyl, the various amyl groups, n-hexyl, methyl isobutyl, heptyl, 2-ethyl hexyl, diisobutyl, isooctyl, nonyl, behenyl, decyl, dodecyl, tridecyl, etc. Illustrative lower alkyl phenyl groups include butyl phenyl, amyl phenyl, heptyl phenyl, etc. Cycloalkyl groups likewise are useful, and these include chiefly cyclohexyl, and the lower alkyl-substituted cyclohexyl groups.

The metal M of the metal dithiophosphate of Formula VII includes Group I metals, Group II metals, aluminum, lead, tin, molybdenum, manganese, cobalt and nickel. In some embodiments, zinc and copper are especially useful metals.

The metal salts represented by Formula VII can be prepared by the same methods as described above with respect to the preparation of the metal salts of component (D). Of course, as mentioned above, when mixtures of alcohols are utilized, the acids obtained are actually statistical mixtures of alcohols.

Another class of the phosphorodithioate additives contemplated for use in the lubricating composition of this invention comprises the adducts of an epoxide with the metal phosphorodithioates of component (D) or those of Formula VII described above. The metal phosphorodithioates useful in preparing such adducts are for the most part the zinc phosphorodithioates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1,1,3-butylene oxide, m-dodecylstyrene oxide, and p-chlorostyrene oxide. The alkylene oxides include principally the lower alkylene oxides in which the alkylene radical contains 8 or less carbon atoms. Examples of such lower alkylene oxides are ethylene oxide, propylene oxide, 1,2-butene oxide, trimethylene oxide, tetramethylene oxide and epichlorohydrin. Procedures for preparing such adducts are known in the art such as in U.S. Pat. No. 3,390,082, and the disclosure of this patent is hereby incorporated by reference for its disclosure of the general procedure for preparing epoxide adducts of the metal salt of phosphorodithioic acids.

Another class of the phosphorodithioate additives contemplated as useful in the lubricating compositions of the invention comprises mixed metal salts of (a) at least one phosphorodithioic acid as defined and exemplified above, and (b) at least one aliphatic or alicyclic carboxylic acid. The carboxylic acid may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^3COOH$, wherein $R^3$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^3$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids.

The mixed metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with a suitable metal base. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

Suitable metal bases for the preparation of the mixed metal salts include the free metals previously enumerated and their oxides, hydroxides, alkoxides and basic salts. Examples are sodium hydroxide, potassium hydroxide, magnesium oxide, calcium hydroxide, zinc oxide, lead oxide, nickel oxide and the like.

The temperature at which the mixed metal salts are prepared is generally between about 30° C. and about 150° C., preferably up to about 125° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,970 describe procedures for preparing these mixed metal salts and disclose a number of examples of such mixed salts. Such disclosures of these patents are hereby incorporated by reference.

In one embodiment, the lubricating oil compositions of the present invention comprise (A) a major amount of oil of lubricating viscosity, from about 0.1 to about 10% by weight of the carboxylic derivative compositions (B) described above, from about 0.01 to about 2% by weight of at least one partial fatty acid ester of a polyhydric alcohol (C) as described above and 0.01 to about 2% by weight of the dithiophosphoric acid (D) described above. In other embodiments, the oil compositions of the present invention may contain at least about 1.0% by weight or even at least about 2.0% by weight of the carboxylic derivative composition (B). The carboxylic derivative composition (B) provides the lubricating oil compositions of the present invention with desirable VI and dispersant properties.

(E) Carboxylic Ester Derivative Compositions:

The lubricating oil compositions of the present invention also may, and often do contain (E) at least one carboxylic ester derivative composition produced by reacting (E-1) at least one substituted succinic acylating agent with (E-2) at least one alcohol or phenol of the general formula $$R^3(OH)_m \qquad \text{(VIII)}$$

wherein $R^3$ is a monovalent or polyvalent organic group joined to the —OH groups through a carbon bond, and m is an integer of from 1 to about 10. The carboxylic ester derivatives (E) are included in the oil compositions to provide additional dispersancy, and in some applications, the ratio of carboxylic derivative (B) to carboxylic ester (E) present in the oil affects the properties of the oil compositions such as the anti-wear properties.

In one embodiment the use of a carboxylic derivative (B) in combination with a smaller amount of the carboxylic esters (E) (e.g., a weight ratio of 2:1 to 4:1) in the presence of the specific metal dithiophosphate (D) of the invention results in oils having especially desirable properties (e.g., anti-wear and minimum varnish and sludge formation). Such oil compositions are particularly used in diesel engines.

The substituted succinic acylating agents (E-1) which are reacted with the alcohols or phenols to form the carboxylic ester derivatives are identical to the acylating agents (B-1) useful in preparing the carboxylic derivatives (B) described above with one exception. The polyalkene from which the substituent is derived is characterized as having a number average molecular weight of at least about 700.

Molecular weights ($\overline{M}n$) of from about 700 to about 5000 are preferred. In one preferred embodiment, the substituent groups of the acylating agent are derived from polyalkenes which are characterized by an $\overline{M}n$ value of about 1300 to 5000 and an $\overline{M}w/\overline{M}n$ value of about 1.5 to about 4.5. The acylating agents of this embodiment are identical to the acylating agents described earlier with respect to the preparation of the carboxylic derivative compositions useful as component (B) described above. Thus, any of the acylating agents described in regard to the preparation of component (B) above, can be utilized in the preparation of the carboxylic ester derivative compositions useful as component (E). When the acylating agents used to prepare the carboxylic ester (E) are the same as those acylating agents used for preparing component (B), the carboxylic ester component (E) will also be characterized as a dispersant having VI properties. Also combinations of component (B) and these preferred types of component (E) used in the oils of the invention provide superior anti-wear characteristics to the oils of the invention. However, other substituted succinic acylating agents also can be utilized in the preparation of the carboxylic ester derivative compositions which are useful as component (E) in the present invention. For example, substituted succinic acylating agents wherein the substituent is derived from a polyalkene having number average molecular weights of about 800 to about 1200 are useful.

The carboxylic ester derivative compositions (E) are those of the above-described succinic acylating agents with hydroxy compounds which may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols (E-2) from which the esters may be derived preferably contain up to about 40 aliphatic carbon atoms. They may be monohydric alcohols such as methanol, ethanol, isooctanol, dodecanol, cyclohexanol, etc. The polyhydric alcohols preferably contain from 2 to about 10 hydroxy groups. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene group contains from 2 to about 8 carbon atoms.

An especially preferred class of polyhydric alcohols are those having at least three hydroxy groups, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters (E) may be prepared by one of several known methods. The method which is preferred because of convenience and the superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C. The water formed as a by-product is removed by distillation as the esterification proceeds.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid groups is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl groups of the alcohol is esterified with one of the two acid groups of the succinic acid. Thus, the maximum proportion of the succinic acid to be used with a polyhydric alcohol is determined by the number of hydroxyl groups present in the molecule of the hydroxy reactant. In one embodiment, esters obtained by the reaction of equimolar amounts of the succinic acid reactant and hydroxy reactant are preferred.

Methods of preparing the carboxylic esters (E) are well known in the art and need not be illustrated in further detail here. For example, see U.S. Pat. No. 3,522,179 which is hereby incorporated by reference for its disclosures of the preparation of carboxylic ester compositions useful as component (E). The preparation of carboxylic ester derivative compositions from acylating agents wherein the substituent groups are derived from polyalkenes characterized by an $\overline{M}n$ of at least about 1300 up to about 5000 and an $\overline{M}w/\overline{M}n$ ratio of from 1.5 to about 4 is described in U.S. Pat. No. 4,234,435 which was incorporated by reference earlier. As noted above, the acylating agents described in the '435 patent are also characterized as having within their structure an average of at least 1.3 succinic groups for each equivalent weight of substituent groups.

The following examples illustrate the esters (E) and the processes for preparing such esters.

EXAMPLE E-1

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is maintained at 240°-250° C./30 mm for 12 hours. The residue is a mixture of the esters resulting from the esterification of one and both hydroxy groups of the glycol. It has a saponification number of 101 and an alcoholic hydroxyl content of 0.2%.

EXAMPLE E-2

The dimethyl ester of the substantially hydrocarbon-substituted succinic anhydride of Example E-1 is prepared by heating a mixture of 2185 grams of the anhydride, 480 grams of methanol, and 1000 cc of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm to remove volatile components. The residue is the desired dimethyl ester.

The carboxylic ester derivatives which are described above resulting from the reaction of an acylating agent with a hydroxy-containing compound such as an alcohol or a phenol may be further reacted with (E-3) an amine, and particularly polyamines in the manner described previously for the reaction of the acylating agent (B-1) with amines (B-2) in preparing component (B). In one embodiment, the amount of amine which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid esters utilized as component (E) are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester derivative compositions which are useful as component (E) are known in the art, and the preparation of a number of these derivatives is described in, for example, U.S. Pat. Nos. 3,957,854 and 4,234,435 which have been incorporated by reference previously. The following specific examples illustrate the preparation of the esters wherein both alcohols and amines are reacted with the acylating agent.

EXAMPLE E-3

A mixture of 334 parts (0.52 equivalent) of the polyisobutene-substituted succinic acylating agent prepared in Example E-2, 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

EXAMPLE E-4

A mixture of 322 parts (0.5 equivalent) of the polyisobutene-substituted succinic acylating agent prepared in Example E-2, 68 parts (2.0 equivalents) of pentaerythritol and 508 parts of mineral oil is heated at 204°-227° C. for 5 hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°-163° C. for one hour, then cooled to 130° C. and filtered. The filtrate is an oil solution of the desired product.

EXAMPLE E-5

A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

EXAMPLE E-6

A mixture of 1000 parts (0.495 mole) of polyisobutene having a number average molecular weight of 2020 and a weight average molecular weight of 6049 and 115 parts (1.17 moles) of maleic anhydride is heated to 184° C. over 6 hours, during which time 85 parts (1.2 moles) of chlorine are added beneath the surface. An additional 59 parts (0.83 mole) of chlorine are added over 4 hours at 184°-189° C. The mixture is blown with nitrogen at 186°-190° C. for 26 hours. The residue is a polyisobutene-substituted succinic anhydride having a total acid number of 95.3.

A solution of 409 parts (0.66 equivalent) of the substituted succinic anhydride in 191 parts of mineral oil is heated to 150° C. and 42.5 parts (1.19 equivalent) of pentaerythritol are added over 10 minutes, with stirring, at 145°-150° C. The mixture is blown with nitrogen and heated to 205°-210° C. over about 14 hours to yield an oil solution of the desired polyester intermediate.

Diethylene triamine, 4.74 parts (0.138 equivalent), is added over one-half hour at 160° C. with stirring, to 988 parts of the polyester intermediate (containing 0.69 equivalent of substituted succinic acylating agent and 1.24 equivalents of pentaerythritol). Stirring is continued at 160° C. for one hour, after which 289 parts of mineral oil are added. The mixture is heated for 16 hours at 135° C. and filtered at the same temperature, using a filter aid material. The filtrate is a 35% solution in mineral oil of the desired amine-modified polyester. It has a nitrogen content of 0.16% and a residual acid number of 2.0.

EXAMPLE E-7

(a) A mixture of 1000 parts of polyisobutene having a number average molecular weight of about 1000 and 108 parts (1.1 moles) of maleic anhydride is heated to about 190° C. and 10 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

(b) A solution of 1000 parts of the acylating agent preparation (a) in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

EXAMPLE E-8

(a) A mixture of 1000 parts (0.495 mole) of polyisobutene having a number average molecular weight of 2020 and a weight average molecular weight of 6049 and 115 parts (1.17 moles) of maleic anhydride is heated to 184° C. over 6 hours, during which time 85 parts (1.2 moles) of chlorine are added beneath the surface. An additional 59 parts (0.83 mole) of chlorine are added over 4 hours at 184°–189° C. The mixture is blown with nitrogen at 186°–190° C. for 26 hours. The residue is a polyisobutene-substituted succinic anhydride having a total acid number of 95.3.

(b) A solution of 409 parts (0.66 equivalent) of the substituted succinic anhydride in 191 parts of mineral oil is heated to 150° C. and 42.5 parts (1.19 equivalent) of pentaerythritol are added over 10 minutes, with stirring, at 145°–150° C. The mixture is blown with nitrogen and heated to 205°–210° C. over about 14 hours to yield an oil solution of the desired polyester intermediate.

Diethylene triamine, 4.74 parts (0.138 equivalent), is added over one-half hour at 160° C. with stirring, to 988 parts of the polyester intermediate (containing 0.69 equivalent of substituted succinic acylating agent and 1.24 equivalents of pentaerythritol). Stirring is continued at 160° C. for one hour, after which 289 parts of mineral oil are added. The mixture is heated for 16 hours at 135° C. and filtered at the same temperature, using a filter aid material. The filtrate is a 35% solution in mineral oil of the desired amine-modified polyester. It has a nitrogen content of 0.16% and a residual acid number of 2.0.

(F) Neutral and Basic Alkaline Earth Metal Salts:

The lubricating oil compositions of the present invention also may contain at least one neutral or basic alkaline earth metal salt of at least one acidic organic compound. Such salt compounds generally are referred to as ash-containing detergents. The acidic organic compound may be at least one sulfur acid, carboxylic acid, phosphorus acid, or phenol, or mixtures thereof.

Calcium, magnesium, barium and strontium are the preferred alkaline earth metals. Salts containing a mixture of ions of two or more of these alkaline earth metals can be used.

The salts which are useful as component (F) can be neutral or basic. The neutral salts contain an amount of alkaline earth metal which is just sufficient to neutralize the acidic groups present in the salt anion, and the basic salts contain an excess of the alkaline earth metal cation. Generally, the basic or overbased salts are preferred. The basic or overbased salts will have metal ratios of up to about 40 and more particularly from about 2 to about 30 or 40.

A commonly employed method for preparing the basic (or overbased) salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. In addition, various promoters may be used in the neutralizing process to aid in the incorporation of the large excess of metal. These promoters include such compounds as the phenolic substances, e.g., phenol and naphthol; alcohols such as methanol, 2-propanol, octyl alcohol and Cellosolve carbitol, amines such as aniline, phenylenediamine, and dodecyl amine, etc. A particularly effective process for preparing the basic salts comprises mixing the acid with an excess of the basic alkaline earth metal in the presence of the phenolic promoter and a small amount of water and carbonating the mixture at an elevated temperature, e.g., 60° C. to about 200° C.

As mentioned above, the acidic organic compound from which the salt of component (F) is derived may be at least one sulfur acid, carboxylic acid, phosphorus acid, or phenol or mixtures thereof. The sulfur acids include the sulfonic acids, thiosulfonic, sulfinic, sulfenic, partial ester sulfuric, sulfurous and thiosulfuric acids.

The sulfonic acids which are useful in preparing component (E) include those represented by the formulae $$R_xT(SO_3H)_y \quad \text{(IX)}$$

and $$R'(SO_3H)_r \quad \text{(X)}$$

In these formulae, R′ is an aliphatic or aliphatic-substituted cycloaliphatic hydrocarbon or essentially hydrocarbon group free from acetylenic unsaturation and containing up to about 60 carbon atoms. When R′ is aliphatic, it usually contains at least about 15 carbon atoms; when it is an aliphatic-substituted cycloaliphatic group, the aliphatic substituents usually contain a total of at least about 12 carbon atoms. Examples of R′ are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R′ are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2–8 carbon atoms per olefinic monomer unit. R′ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula IX is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R′ or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–2 per molecule and are generally also 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the salts (F). It is to be understood that such examples serve also to illustrate the salts of such sulfonic acids useful as component (F). In other words, for every sulfonic acid enumerated, it is intended that the corresponding basic alkali metal salts thereof are also understood to be illustrated. (The same applies to the lists of other acid materials listed below.) Such sulfonic acids include mahogany sulfonic acids, bright stock sulfonic acids, petroleum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts which can be incorporated into the lubricating oil compositions of this invention as component (F), and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids from which useful alkaline earth metal salts (F) can be prepared include aliphatic, cycloaliphatic and aromatic mono- and polybasic carboxylic acids including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl- and alkenyl-succinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

The pentavalent phosphorus acids useful in the preparation of component (F) may be an organophosphoric, phosphonic or phosphinic acid, or a thio analog of any of these.

Component (F) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alyyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, etc.

The equivalent weight of the acidic organic compound is its molecular weight divided by the number of acidic groups (i.e., sulfonic acid or carboxy groups) present per molecule.

In one embodiment, overbased alkaline earth metal salts of organic acidic compounds are preferred. Salts having metal ratios of at least about 2 and more, generally from about 2 to about 40, more preferably up to about 20 are useful.

The amount of component (F) included in the lubricants of the present invention also may be varied over a wide range, and useful amounts in any particular lubricating oil composition can be readily determined by one skilled in the art. Component (F) functions as an auxiliary or supplemental detergent. The amount of component (F) contained in a lubricant of the invention may vary from about 0% or about 0.01% up to about 5% or more.

The following examples illustrate the preparation of neutral and basic alkaline earth metal salts useful as component (F).

EXAMPLE F-1

A mixture of 906 parts of an oil solution of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°–85° C. for 7 hours at a rate of about 3 cubic feet of carbon dioxide per hour. The reaction mixture is constantly agitated throughout the carbonation. After carbonation, the reaction mixture is stripped to 165° C./20 torr and the residue filtered. The filtrate is an oil solution (34% oil) of the desired overbased magnesium sulfonate having a metal ratio of about 3.

EXAMPLE F-2

A polyisobutenyl succinic anhydride is prepared by reacting a chlorinated poly(isobutene) (having an average chlorine content of 4.3% and an average of 82 carbon atoms) with maleic anhydride at about 200° C. The resulting polyisobutenyl succinic anhydride has a saponification number of 90. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate containing the desired product.

EXAMPLE F-3

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added 1000 parts of an alkyl phenyl sulfonic acid having an average molecular weight (vapor phase osmometry) of 500 with mixing. The mixture then is blown with carbon dioxide at a temperature of about 50° C. at the rate of about 5.4 pounds per hour for about 2.5 hours. After carbonation, 102 additional parts of oil are added and the mixture is stripped of volatile materials at a temperature of about 150°–155° C. at 55 mm. pressure. The residue is filtered and the filtrate is the desired oil solution of the overbased calcium sulfonate having calcium content of about 3.7% and a metal ratio of about 1.7.

EXAMPLE F-4

A mixture of 490 parts (by weight) of a mineral oil, 110 parts of water, 61 parts of heptylphenol, 340 parts of barium mahogany sulfonate, and 227 parts of barium oxide is heated at 100° C. for 0.5 hour and then to 150° C. Carbon dioxide is then bubbled into the mixture until the mixture is substantially neutral. The mixture is filtered and the filtrate found to have a sulfate ash content of 25%.

The lubricating oil compositions of the present invention also may contain friction modifiers in addition to component (C) to provide the lubricating oil with additional desirable frictional characteristics. Various amines, particularly tertiary amines are effective friction modifiers. Examples of tertiary amine friction modifiers include N-fatty alkyl-N,N-diethanol amines, N-fatty alkyl-N,N-diethoxy ethanol amines, etc. Such tertiary amines can be prepared by reacting a fatty alkyl amine with an appropriate number of moles of ethylene oxide. Tertiary amines derived from naturally occurring substances such as coconut oil and oleoamine are available from Armour Chemical Company under the trade designation "Ethomeen". Particular examples are the Ethomeen-C and the Ethomeen-O series.

Sulfur-containing compounds such as sulfurized $C_{12-24}$ fats, alkyl sulfides and polysulfides wherein the alkyl groups contain from 1 to 8 carbon atoms, and sulfurized polyolefins also may function as friction modifiers in the lubricating oil compositions of the invention.

(G) Neutral and Basic Salts of Phenol Sulfides:

In one embodiment, the oils of the invention may contain at least one neutral or basic alkaline earth metal salt of an alkylphenol sulfide. The oils may contain from about 0 to about 2 or 3% of said phenol sulfides. More often, the oil may contain from about 0.01 to about 2% by weight of the basic salts of phenol sulfides. The term "basic" is used herein the same way in which it was used in the definition of other components above, that is, it refers to salts having a metal ratio in excess of 1 when incorporated into the oil compositions of the invention. The neutral and basic salts of phenol sulfides provide antioxidant and detergent properties of the oil compositions of the invention and improve the performance of the oils in Caterpillar testing.

The alkylphenols from which the sulfide salts are prepared generally comprise phenols containing hydrocarbon substituents with at least about 6 carbon atoms; the substituents may contain up to about 7000 aliphatic carbon atoms. Also included are substantially hydrocarbon substituents, as defined hereinabove. The preferred hydrocarbon substituents are derived from the polymerization of olefins such as ethylene, propene, etc.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. The molar ratio of the phenol to the sulfur compound can be from about 1:0.5 to about 1:1.5, or higher. For example, phenol sulfides are readily obtained by mixing, at a temperature above about 60° C., one mole of an alkylphenol and about 0.5–1 mole of sulfur dichloride. The reaction mixture is usually maintained at about 100° C. for about 2–5 hours, after which time the resulting sulfide is dried and filtered. When elemental sulfur is used, temperatures of about 200° C. or higher are sometimes desirable. It is also desirable that the drying operation be conducted under nitrogen or a similar inert gas.

Suitable basic alkyl phenol sulfides are disclosed, for example, in U.S. Pat. Nos. 3,372,116, 3,410,798 and 3,562,159 which are hereby incorporated by reference.

The following example illustrates the preparation of these basic materials.

EXAMPLE G-1

A phenol sulfide is prepared by reacting sulfur dichloride with a polyisobutenyl phenol in which the polyisobutenyl substituent has an average of 23.8 carbon atoms, in the presence of sodium acetate (an acid acceptor used to avoid discoloration of the product). A mixture of 1755 parts of this phenol sulfide, 500 parts of mineral oil, 335 parts of calcium hydroxide and 407 parts of methanol is heated to about 43°–50° C. and carbon dioxide is bubbled through the mixture for about 7.5 hours. The mixture is then heated to drive off volatile matter, an additional 422.5 parts of oil are added to provide a 60% solution in oil. This solution contains 5.6% calcium and 1.59% sulfur.

(H) Sulfurized Olefins

The oil compositions of the present invention also may contain (H) one or more sulfur-containing composition useful in improving the antiwear, extreme pressure and antioxidant properties of the lubricating oil compositions. Sulfur-containing compositions prepared by the sulfurization of various organic materials including olefins are useful. The olefins may be any aliphatic, arylaliphatic or alicyclic olefinic hydrocarbon containing from about 3 to about 30 carbon atoms.

The olefinic hydrocarbons contain at least one olefinic double bond, which is defined as a non-aromatic double bond; that is, one connecting two aliphatic carbon atoms. Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

U.S. Pat. Nos. 4,119,549 and 4,505,830 are incorporated by reference herein for their disclosure of suitable sulfurized olefins useful in the lubricating oils of the present invention. Several specific sulfurized compositions are described in the working examples thereof.

Sulfur-containing compositions characterized by the presence of at least one cycloaliphatic group with at least two nuclear carbon atoms of one cycloaliphatic group or two nuclear carbon atoms of different cycloaliphatic groups joined together through a divalent sulfur linkage also are useful in component (H) in the lubricating oil compositions of the present invention. These types of sulfur compounds are described in, for example, U.S. Pat. No. Re. 27,331, the disclosure which is hereby incorporated by reference. The sulfur linkage contains at least two sulfur atoms, and sulfurized Diels-Alder adducts are illustrative of such compositions.

The following example illustrates the preparation of one such composition.

EXAMPLE H-1

(a) A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 moles) of butylacrylate and 240.8 grams of toluene is added to the $AlCl_3$ slurry over a 0.25-hour period while maintaining the temperature within the range of 37°–58° C. Thereafter, 313 grams (5.8 moles) of butadiene are added to the slurry over a 2.75-hour period while maintaining the temperature of the reaction mass at 60°–61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9–10 millimeters of mercury whereupon 785 grams of the desired adduct are collected over the temperature of 105°–115° C.

(b) The above-prepared adduct of butadiene-butylacrylate (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°–155° C. for 7 hours while passing nitrogen therethrough at a rate of about 0.5 cubic feet per hour. After heating, the mass is permitted to cool to room temperature and filtered, the sulfur-containing product being the filtrate.

Other extreme pressure agents and corrosion- and oxidation-inhibiting agents also may be included and are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith Lezius-Hiles Co. publishers, Cleveland, Ohio, 1967.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents" by Henry T. Kerner (Noyes Data Corporation, 1976), pages 125–162.

The lubricating oil compositions of the present invention also may contain, particularly when the lubricating oil compositions are formulated into multigrade oils, one or more commercially available viscosity modifiers. Viscosity modifiers generally are polymeric materials characterized as being hydrocarbon-based polymers generally having number average molecular weights between about 25,000 and 500,000 more often between about 50,000 and 200,000.

Polyisobutylene has been used as a viscosity modifier in lubricating oils. Polymethacrylates (PMA) are prepared from mixtures of methacrylate monomers having different alkyl groups. Most PMA's are viscosity modifiers as well as pour point depressants. The alkyl groups may be either straight chain or branched chain groups containing from 1 to about 18 carbon atoms.

When a small amount of a nitrogen-containing monomer is copolymerized with alkyl methacrylates, dispersancy properties also are incorporated into the product. Thus, such a product has the multiple function of viscosity modification, pour point depressants and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity-modifiers.

Ethylene-propylene copolymers, generally referred to as OCP can be prepared by copolymerizing ethylene and propylene, generally in a solvent, using known catalysts such as a Ziegler-Natta initiator. The ratio of ethylene to propylene in the polymer influences the oil-solubility, oil-thickening ability, low temperature viscosity, pour point depressant capability and engine performance of the product. The common range of ethylene content is 45–60% by weight and typically is from 50% to about 55% by weight. Some commercial OCP's are terpolymers of ethylene, propylene and a small amount of nonconjugated diene such as 1,4-hexadiene. In the rubber industry, such terpolymers are referred to as EPDM (ethylene propylene diene monomer). The use of OCP's as viscosity-modifiers in lubricating oils has increased rapidly since about 1970, and the OCP's are currently one of the most widely used viscosity modifiers for motor oils.

Esters obtained by copolymerizing styrene and maleic anhydride in the presence of a free radical initiator and thereafter esterifying the copolymer with a mixture of $C_{4-18}$ alcohols also are useful as viscosity-modifying additives in motor oils. The styrene esters generally are considered to be multi-functional premium viscosity-modifiers. The styrene esters in addition to their viscosity-modifying properties also are pour point depressants and exhibit dispersancy properties when the esterification is terminated before its completion leaving some unreacted anhydride or carboxylic acid groups. These acid groups can then be converted to imides by reaction with a primary amine.

Hydrogenated styrene-conjugated diene copolymers are another class of commercially available viscosity-modifiers for motor oils. Examples of styrenes include styrene, alpha-methyl styrene, ortho-methyl styrene, meta-methyl styrene, para-methyl styrene, para-tertiary butyl styrene, etc. Preferably the conjugated diene contains from four to six carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above-described hydrogenated copolymers have been described in the prior art such as in U.S. Pat. Nos. 3,551,336; 3,598,738; 3,554,911; 3,607,749; 3,687,849; and 4,181,618 which are hereby incorporated by reference for their disclosures of polymers and copolymers useful as viscosity modifiers in the oil compositions of this invention. For example, U.S. Pat. No. 3,554,911 describes a hydrogenated random butadiene-styrene copolymer, its preparation and hydrogenation. The disclosure of this patent is incorporated herein by reference. Hydrogenated styrene-butadiene copolymers useful as viscosity-modifiers in the lubricating oil compositions of the present invention are available commercially from, for example, BASF under the general trade designation "Glissoviscal". A particular example is a hydrogenated styrene-butadiene copolymer available under the designation Glissoviscal 5260 which has a molecular weight, determined by gel permeation chromatography, of about 120,000. Hydrogenated styreneisoprene copolymers useful as viscosity modifiers are available from, for example, The Shell Chemical Company under the general trade designation "Shellvis". Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The amount of polymeric viscosity modifier incorporated in the lubricating oil compositions of the present invention may be varied over a wide range although lesser amounts than normal are employed in view of the ability of the carboxylic acid derivative component (B) (and certain of the carboxylic ester derivatives (E)) to function as viscosity modifiers in addition to functioning as dispersants. In general, the amount of polymeric viscosity-improver included in the lubricating oil compositions of the invention may be as high as 10% by weight based on the weight of the finished lubricating oil. More often, the polymeric viscosity-improvers are used in concentrations of about 0.2 to about 8% and more particularly, in amounts from about 0.5 to about 6% by weight of the finished lubricating oil.

The lubricating oils of the present invention may be prepared by dissolving or suspending the various components directly in a base oil along with any other additives which may be used. More often, the chemical components of the present invention are diluted with a substantially inert, normally liquid organic diluent such as mineral oil, naphtha, benzene, toluene or xylene to form an additive concentrate. These concentrates usually comprise from about 0.01 to about 80% by weight of one or more of the additive components (A) through (H) described above, and may contain, in addition, one or more of the other additives described above. Chemical concentrations such as 15%, 20%, 30% or 50% or higher may be employed.

For example, concentrates may contain on a chemical basis, from about 10 to about 50% by weight of the carboxylic derivative composition (B), from about 0.1 to about 15% by weight of the partial fatty acid ester of a polyhydric alcohol (C) and from about 0.01 to about 15% by weight of the metal phosphorodithioate (D). The concentrates also may contain from about 1 to about 30% by weight of the carboxylic ester (E) and/or from about 1% to about 20% by weight of at least one neutral or basic alkaline earth metal salt (F).

The following examples illustrate concentrates of the present invention.

| | Parts by Wt. |
|---|---|
| Concentrate I | |
| Product of Example B-1 | 45 |
| Product of Example C-1 | 10 |
| Product of Example D-1 | 12 |
| Mineral Oil | 33 |
| Concentrate II | |
| Product of Example B-2 | 60 |
| Product of Example C-1 | 10 |
| Product of Example D-2 | 10 |
| Product of Example E-4 | 5 |
| Mineral Oil | 15 |
| Concentrate III | |
| Product of Example B-1 | 35 |
| Emerest 2421 | 5 |
| Product of Example D-1 | 5 |
| Product of Example E-5 | 5 |
| Mineral Oil | 50 |

Typical lubricating oil compositions according to the present invention are exemplified in the following lubricating oil examples.

| | Lubricants | | |
|---|---|---|---|
| Component/Example (% Vol.) | I | II | II |
| Base oil | (a) | (b) | (a) |
| Grade | 15W-45 | 10W-30 | 30 |
| VI Type* | (1) | (1) | — |
| Product of Example B-1 | 4.47 | — | 4.75 |
| Product of Example B-2 | — | 4.6 | — |
| Emerest 2421 | 0.20 | 0.20 | 0.20 |
| Product of Example D-1 | 1.54 | 1.54 | 1.45 |
| Product of Example E-5 | 1.41 | 1.50 | 1.60 |
| Product of Example F-1 | 0.44 | 0.45 | 0.50 |
| Basic calcium alkylated benzene sulfonate (52% oil, MR of 12) | 0.97 | 0.97 | 0.80 |
| Reaction product of alkyl phenol with sulfur dichloride (42% oil) | 2.48 | 2.48 | 2.25 |
| Pour point depressant | 0.2 | 0.2 | 0.2 |
| Silicone anti-foam agent | 100 ppm | 100 ppm | 100 ppm |

(a) Mid-Continent-solvent refined.
(b) Mid-East stock.
(1) A di-block copolymer of styrene isoprene; number average molecular weight = 155,000.
*The amount of polymeric VI included in each lubricant is an amount required to have the finished lubricant meet the viscosity requirements of the indicated multigrade.

| | % w |
|---|---|
| Example IV | |
| Product of Example B-2 | 6.0 |
| Product of Example C-2 | 0.10 |
| Product of Example D-1 | 1.45 |
| 100 Neutral Paraffinic Oil | remainder |
| Example V | |
| Product of Example B-1 | 4.6 |

-continued

| | % w |
|---|---|
| Product of Example C-2 | 0.15 |
| Product of Example D-1 | 1.45 |
| Product of Example E-5 | 1.5 |
| 100 Neutral Paraffinic Oil | remainder |

The lubricating oil compositions of the present invention exhibit a reduced tendency to deteriorate under conditions of use and thereby reduce wear and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile. In one embodiment, lubricating oils can be formulated within this invention which can pass all of the tests required for classification as an SG oil. The lubricating oils of this invention are useful also in diesel engines, and lubricating oil formulations can be prepared in accordance with this invention which meet the requirements of the new diesel classification CE.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating oil composition for internal combustion engines which comprises:

(A) a major amount of oil of lubricating viscosity, and minor amounts of (B) at least one carboxylic derivative composition produced by reacting (B-1) at least one substituted succinic acylating agent with (B-2) from one equivalent up to two moles, per equivalent of acylating agent, of at least one amine compound characterized by the presence within its structure of at least one HN< group wherein said substituted succinic acylating agents consist of substituent groups and succinic groups wherein the substituent groups are derived from polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, (C) at least one partial fatty acid ester of a polyhydric alcohol, and (D) at least one metal salt of a dihydrocarbyl dithiophosphoric acid wherein (D-1) the dithiophosphoric acid is prepared by reacting phosphorus pentasulfide with an alcohol mixture comprising at least 10 mole percent of isopropyl alcohol, secondary butyl alcohol, or a mixture of isopropyl and secondary butyl alcohols, and at least one primary aliphatic alcohol containing from about 3 to about 13 carbon atoms, and (D-2) the metal is a Group II metal, aluminum, tin, iron, cobalt, lead, molybdenum, manganese, nickel or copper.

2. The oil composition of claim 1 containing at least about 1% by weight of the carboxylic derivative composition (B).

3. The oil composition of claim 1 wherein the value of $\overline{Mn}$ in (B) is at least about 1500.

4. The oil composition of claim 1 wherein the value of $\overline{Mw}/\overline{Mn}$ in (B) is at least about 2.0.

5. The oil composition of claim 1 wherein the substituent groups in (B) are derived from one or more polyalkenes selected from the group consisting of homopolymers and interpolymers of terminal olefins of from 2 to about 16 carbon atoms with the proviso that said interpolymers can optionally contain up to about 25% of polymer units derived from internal olefins of up to about 6 carbon atoms.

6. The oil composition of claim 1 wherein the substituent groups are derived from a member selected from the group consisting of polybutene, ethylene-propylene copolymer, polypropylene, and mixtures of two or more of any of these.

7. The oil composition of claim 1 wherein the amine (B-2) is an aliphatic, cycloaliphatic or aromatic polyamine.

8. The oil composition of claim 1 wherein the amine (B-2) is characterized by the general formula $$\underset{\underset{R^3}{|}}{R^3N}-(U-\underset{\underset{R^3}{|}}{N})_n-R^3 \qquad \text{(VI)}$$

wherein n is from 1 to about 10; each $R^3$ is independently a hydrogen atom, a hydrocarbyl group or a hydroxy-substituted or an amino-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms.

9. The oil composition of claim 1 wherein the fatty acid ester in (C) contains from about 10 to about 22 carbon atoms.

10. The oil composition of claim 1 wherein the polyhydric alcohol of (C) is glycerol.

11. The oil composition of claim 1 wherein the primary aliphatic alcohol in (D-1) contains from about 6 to about 13 carbon atoms.

12. The oil composition of claim 1 wherein the metal of (D-2) is zinc, copper, or mixtures of zinc and copper.

13. The oil composition of claim 1 wherein the metal of (D-2) is zinc.

14. The oil composition of claim 1 wherein the alcohol mixture in (D-1) comprises at least 20 mole percent of isopropyl alcohol.

15. The oil composition of claim 1 also containing (E) at least one carboxylic ester derivative composition produced by reacting (E-1) at least one substituted succinic acylating agent comprising substituent groups and succinic groups wherein the substituent groups have an Mn of at least about 700 with (E-2) at least one alcohol of the general formula $$R^3(OH)_m \qquad \text{(VIII)}$$

wherein $R^3$ is a monovalent or polyvalent organic group joined to the —OH groups through carbon bonds, and m is an integer of from 1 to about 10.

16. The oil composition of claim 15 wherein the substituent groups in (E-1) are derived from a member selected from the group consisting of polybutene, ethylene-propylene copolymer, polypropylene, and mixtures of two or more of any of these.

17. The oil composition of claim 15 wherein the alcohol (E-2) is neopentyl glycol, ethylene glycol, glycerol, pentaerythritol, sorbitol, mono-alkyl or monoaryl ethers of a poly(oxyalkylene) glycol, or mixtures of any one of these.

18. The oil composition of claim 15 wherein the carboxylic ester derivative composition (E) prepared by reacting the acylating agent (E-1) with the alcohol (E-2) is further reacted with (E-3) at least one amine containing at least one HN< group.

19. The oil composition of claim 15 wherein the substituted succinic acylating agent (E-1) consists of substituent groups and succinic groups wherein the substituent groups are derived from a polyalkene, said polyalkene being characterized by an $\overline{Mn}$ value of about 1300 to about 5000 and an $\overline{Mw}/\overline{Mn}$ value of from about 1.5 to about 4.5, said acylating agents being characterized by the presence within their structure of at least about 1.3 succinic groups for each equivalent weight of substituent group.

20. The oil composition of claim 19 wherein the carboxylic ester prepared by reacting the acylating agent with the alcohol is further reacted with (E-3) at least one amine containing at least one HN< group.

21. The oil composition of claim 20 wherein the amine (E-3) is a polyamine.

22. The oil composition of claim 20 wherein the amine (E-3) is an alkylene polyamine.

23. The oil composition of claim 1 also containing (F) at least one neutral or basic alkaline earth metal salt of at least one acidic organic compound.

24. The oil composition of claim 23 wherein the acidic organic compound in (F) is a sulfur acid, carboxylic acid, phosphorus acid, phenol, or mixtures thereof.

25. The oil composition of claim 23 wherein the acidic compound in (F) is at least one organic sulfonic acid.

26. The oil composition of claim 25 wherein the sulfonic acid is an alkylated benzene sulfonic acid.

27. A lubricating oil composition for internal combustion engines which comprises (A) a major amount of oil of lubricating viscosity, (B) from about 0.5% to about 10% by weight of at least one carboxylic derivative composition produced by reacting (B-1) at least one substituted succinic acylating agent with from 1 equivalent up to about 2 moles, per equivalent of acylating agent, of (B-2) at least one polyamine characterized by the presence within its structure of at least one HN< group wherein said substituted succinic acylating agent consists of substituent groups and succinic groups wherein the substituent groups are derived from a polyalkene, said polyalkene being characterized by an Mn value of about 1300 to about 5000 and an Mw/Mn value of about 2 to about 4.5, said acylating agents being characterized by the presence within their structure of an average of at least 1.3 succinic groups for each equivalent weight of substituent groups, (C) from about 0.01 to about 2% by weight of at least one partial fatty acid ester of a polyhydric alcohol, (D) from about 0.05 to about 5% by weight of at least one metal salt of a dihydrocarbyl dithiophosphoric acid wherein (D-1) the dithiophosphoric acid is prepared by reacting phosphorus pentasulfide with an alcohol mixture comprising at least 10 mole percent of isopropyl alcohol, secondary butyl alcohol or a mixture of isopropyl and secondary butyl alcohols, and at least one primary aliphatic alcohol containing from about 3 to about 13 carbon atoms, and (D-2) the metal is a Group II metal, aluminum, tin, iron, cobalt, lead, molybdenum, manganese, nickel or copper, (E) 0.1 to about 10% of at least one carboxylic ester derivative composition produced by reacting (E-1) at least one substituted succinic acylating agent comprising substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4.5, said acylating agents being characterized by the presence within their structure of at least about 1.3 succinic groups for each equivalent weight of substituent group with (E-2) at least one alcohol of the general formula $$R^3(OH)_m \qquad \text{(VIII)}$$

wherein $R^3$ is a monovalent or polyvalent organic group joined to the —OH groups through carbon bonds, and m is an integer of from 2 to about 10, and (E-3) at least one polyamine compound containing at least one >NH group, and (F) from about 0.01 to about 5% by weight of at least one alkaline earth metal salt of an organic acid compound selected from the group consisting of sulfur acids, carboxylic acids, phosphorus acids, phenols, and mixtures of said acids.

28. The oil composition of claim 27 containing at least about 1.0% by weight of the carboxylic derivative composition (B).

29. The oil composition of claim 27 wherein the amines (B-2) and (E-3) are each independently polyamines characterized by the general formula $$\underset{\underset{R^3}{|}}{R^3N}-\underset{\underset{R^3}{|}}{(UN)_n}-R^3 \qquad \text{(VI)}$$

wherein n is an integer from 1 to about 10, each $R^3$ is independently a hydrogen atom, a hydrocarbyl group or a hydroxy-substituted or an amino-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms.

30. The oil composition of claim 27 wherein the primary aliphatic alcohol in (D-1) contains from about 6 to about 13 carbon atoms.

31. The oil composition of claim 27 wherein the metal of (D-2) is zinc, copper, or mixtures of zinc and copper.

32. The oil composition of claim 27 wherein the metal of (D-2) is zinc.

33. The oil composition of claim 27 wherein the alcohol mixture in (D-1) comprises at least 20 mole percent of isopropyl alcohol.

34. The oil composition of claim 27 wherein the alcohol (E-2) is neopentyl glycol, ethylene glycol, glycerol, pentaerythritol, sorbitol, mono-alkyl or monoaryl ethers of a poly(oxyalkylene) glycol, or mixtures of any two or more of these.

35. A lubricating oil composition for internal combustion engines which comprises (A) a major amount of oil of lubricating viscosity, (B) from about 1% to about 10% by weight of at least one carboxylic derivative composition produced by reacting (B-1) at least one substituted succinic acylating agent with from 1.0 to about 1.5 equivalents, per equivalent of acylating agent, of (B-2) at least one polyamine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 2 to about 4.5, said acylating agents being characterized by the presence within their structure of an average of at least 1.3 succinic groups for each equivalent weight of substituent groups, (C) from about 0.05 to about 2% by weight of at least one partial fatty acid ester of glycerol, (D) from about 0.05 to about 5% by weight of at least one metal salt of a dihydrocarbyl dithiophosphoric acid wherein (D-1) the dithiophosphoric acid is prepared by reacting phosphorus pentasulfide with an alcohol mixture comprising at least about 20 mole percent of isopropyl alcohol and at least one primary aliphatic alcohol containing from about 6 to about 13 carbon atoms, and II metal, (D-2) the metal is a Group II metal, aluminum, tin, iron, cobalt, lead, molybdenum, manganese, nickel or copper, (E) 0.1 to about 10% of at least one carboxylic ester derivative composition produced by reacting (E-1) at least one substituted succinic acylating agent comprising substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4.5, said acylating agents being characterized by the presence within their structure of at least about 1.3 succinic groups for each equivalent weight of substituent group with (E-2) from about 0.1 to about 2 moles, per mole of acylating agent of at least one polyhydroxy compound selected from the group consisting of neopentyl glycol, ethylene glycol glycerol, pentaerythritol, sorbitol, mono-alkyl or mono-aryl ethers of a poly(oxyalkylene)glycol or mixtures of any two or more of these and (E-3) at least one polyamine containing at least one >NH group, and (F) from about 0.01 to about 5% by weight of at least one alkaline earth metal salt of an organic acid compound selected from the group consisting of sulfonic acids, carboxylic acids, phenols, and mixtures of said acids.

36. The oil composition of claim 35 wherein the polyamines (B-2) and (E-3) are each independently polyamines characterized by the general formula $$\underset{\underset{R^3}{|}}{R^3N}-\underset{\underset{R^3}{|}}{(UN)_n}-R^3 \qquad \text{(VI)}$$

wherein n is an integer from 1 to about 10, each $R^3$ is independently a hydrogen atom, a hydrocarbyl group or a hydroxy-substituted or an amino-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms.

37. The oil composition of claim 35 wherein (F) comprises a mixture of basic alkaline earth metal salts of organic sulfonic acids.

38. A concentrate for formulating lubricating oil compositions comprising from about 20 to about 90% by weight of a normally liquid, substantially inert organic diluent/solvent, (B) from about 10 to about 50% by weight of at least one carboxylic derivative composition produced by reacting (B-1) at least one substituted succinic acylating agent with at least one equivalent, per equivalent of acylating agent, of (B-2) at least one amine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, (C) from about 0.1 to about 15% by weight of at least one fatty acid ester of a polyhydric alcohol, and of (D) from about 0.001 to about 15% by weight at least one metal salt of a dihydrocarbyl dithiophosphoric acid wherein (D-1) the dithiophosphoric acid is prepared by reacting phosphorus pentasulfide with an alcohol mixture comprising at least 10 mole percent of isopropyl alcohol, secondary butyl alcohol or a mixture of isopropyl and secondary butyl alcohols, and at least one primary aliphatic alcohol containing from about 3 to about 13 carbon atoms, and (D-2) the metal is a Group II metal, aluminum, tin, iron, cobalt, lead, molybdenum, manganese, nickel or copper.

39. The concentrate of claim 38 also containing from about 1% by weight to about 30% by weight of (E) at least one carboxylic ester derivative composition produced by reacting (E-1) at least one substituted succinic acylating agent comprising substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4.5, said acylating agents being characterized by the presence within their structure of at least about 1.3 succinic groups for each equivalent weight of substituent group with (E-2) at least one alcohol of the general formula $$R^3(OH)_m \qquad \text{(VIII)}$$

wherein $R^3$ is a monovalent or polyvalent organic group joined to the —OH groups through carbon bonds, and m is an integer of from 1 to about 10.

40. The concentrate of claim 39 wherein the carboxylic ester (E) produced by reacting the acylating agent (E-1) with the alcohol (E-2) is further reacted with (E-3) at least one polyamine containing at least one HN< group.

41. The concentrate of claim 38 also containing from about 1% by weight to about 20% by weight of (F) at least one neutral or basic alkaline earth metal salt of at least one acidic organic compound.

42. The concentrate of claim 39 also containing from about 1% by weight to about 20% by weight of (F) at least one neutral or basic alkaline earth metal salt of at least one acidic organic compound.

* * * * *